United States Patent [19]

Gamberini

[11] Patent Number: 4,545,412

[45] Date of Patent: Oct. 8, 1985

[54] MACHINE FOR FILLING A CONTAINER WITH PHARMACEUTICAL PRODUCTS FORMED BY PASTE

[75] Inventor: Ernesto Gamberini, Rostignano-Pianoro, Italy

[73] Assignee: MG2 S.p.A., Pian di Macina Pianoro, Italy

[21] Appl. No.: 497,825

[22] Filed: May 25, 1983

[30] Foreign Application Priority Data

May 25, 1982 [IT] Italy ..... 3437 A/82

[51] Int. Cl.[4] ..... B65B 3/04

[52] U.S. Cl. ..... 141/129; 141/256; 141/258

[58] Field of Search ..... 141/1-12, 141/71-83, 250-284, 234-248, 129-191; 425/110, 113, 114, 127, 129 R, 376 R, 377

[56] References Cited

U.S. PATENT DOCUMENTS 2,675,154 4/1954 Fishburne ..... 141/248

*Primary Examiner*—Houston S. Bell, Jr.

*Attorney, Agent, or Firm*—Frost & Jacobs

[57] ABSTRACT

A filling machine for capsules, in which a pharmaceutical paste contained in a hopper is fed under pressure to a dosing chamber, the inlet and the outlet of which are controlled by a dosing member adapted to receive some paste and movable within the dosing chamber between a paste receiving position, in which the dosing member communicates with the dosing chamber inlet, but not with the outlet thereof, and a paste releasing position, in which the dosing member closes the inlet of the dosing chamber and communicates with the outlet thereof to deliver to an external capsule a metered quantity of paste pushed through the chamber outlet by a piston engaging the dosing member.

6 Claims, 5 Drawing Figures

MACHINE FOR FILLING A CONTAINER WITH PHARMACEUTICAL PRODUCTS FORMED BY PASTE

BACKGROUND OF THE INVENTION

The present invention relates to a machine for filing capsules with a pharmaceutical paste.

The machine of the present invention is normally used in combination with a first feeding machine for empty capsules, a second machine receiving said empty capsules and separating a bottom portion of each of said capsules from a closing cap thereof, before feeding said bottom portions to the filling machine of the present invention, and a third machine receiving said bottom portions from the filling machine of the invention, and closing said bottom portions with the relevant closing caps.

In the pharmaceutical field, products in the form of paste are normally preferred to corresponding products in the form of powder since pastes mix together better than powders, are more easily absorbed by the patients, and do not involve pollution problems during handling. However, in general, when capsules are used, the pharmaceutical products contained therein are normally in the form of powders owing to the difficulties involved in dosing the same products in the form of pastes, and in introducing doses of paste into the capsules.

SUMMARY OF THE INVENTION

It is an object of the present invention to overcome the above difficulties by providing a very simple and effective machine for filling capsules with a pharmaceutical paste.

According to the present invention there is provided a machine for filling capsules with a pharmaceutical paste, comprising a hopper for said paste; a first outlet for said paste provided on said hopper; first pressure means cooperating with said hopper to push said paste in said hopper towards said first outlet; at least one dosing chamber for said paste; a first inlet and a second outlet for said paste provided on said dosing chamber, said first inlet communicating with said first outlet; a conveyor for a plurality of paste receiving bottom portions of capsules, said second outlet facing said conveyor; a dosing member arranged inside said dosing chamber and movable therein between a paste receiving position and a paste dispensing position; and a second inlet and a third outlet for said paste provided on said dosing member; said second inlet communicating with said first inlet when said dosing member is arranged in said paste receiving position, said third outlet communicating with said second outlet when said dosing member is arranged in said paste dispensing position, and second pressure means being provided which cooperates with said dosing member to push the paste therein towards said third outlet.

BRIEF DESCRIPTION OF THE DRAWINGS

The invention will be described by way of example with reference to the accompanying drawings.

DETAILED DESCRIPTION OF THE INVENTION

Figure 1:
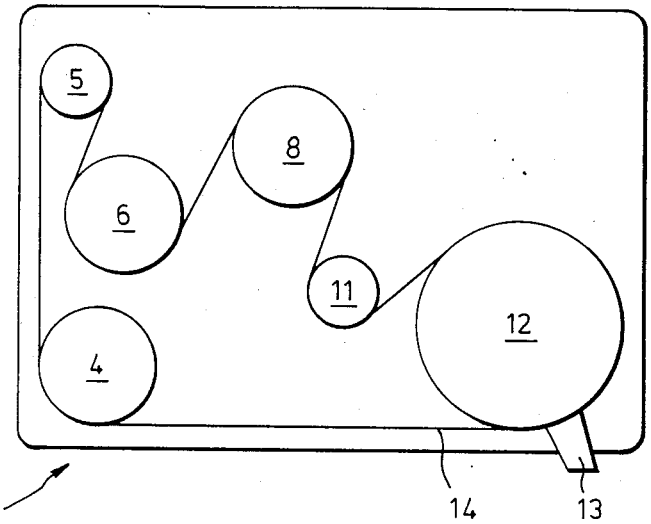
FIG. 1 is a schematic diagram of a filling plant for capsules including the filling machine of the invention.

FIG. 1 shows a plant 1 for filling capsules with pharmaceutical products, the capsules each consisting of a paste receiving bottom 2 (see FIG. 2) and a closing cap 3.

Plant 1 comprises a feeding machine 4 for feeding the capsules, a separating machine 5 for separating each cap 3 from the respective bottom 2, a filling machine 6 for filling each bottom 2 with a dose of pharmaceutical paste 7 (FIG. 2), a second filling machine 8 for filling each bottom 2 with a pharmaceutical powder or tablets, an adjoining machine 11 for closing each bottom 2 with the respective cap 3, a sealing machine 12 for sealing the capsules, and an outlet station 13 for the sealed capsules. If desired, machine 8 may be bypassed.

Bottoms 2 and the respective caps 3 are advanced through plant 1 by means of a conveyor 14, which acts as a transmission member engaging all the above machines, normally of the revolving type, to impart to the machines a rotation about their vertical axes, only one of the above machines being motorized and acting as a driving means for conveyor 14.

With reference now to FIG. 1, filling machine 6 comprises a rotary hopper 16, in which paste 7 is arranged. Hopper 16 comprises upper and lower cylindrical portions 17 and 21 connected to one another by an intermediate frusto-conical portion 18. Lower portion 21 defines a lower annular recess, which accommodates the upper ends of two annular members 23 and 24 both having an L-shaped cross section. Members 23 and 24 are coaxial with portion 21 and are arranged so that member 23 is outside of and surrounds member 24; and member 23 is welded at 22 to the lower end of portion 21.

Two superimposed rams of members 23 and 24 extend radially outside portion 21, and are rigidly connected to one another and to the upper end of an annular drum 25, coaxial with hopper 16.

Figure 3:
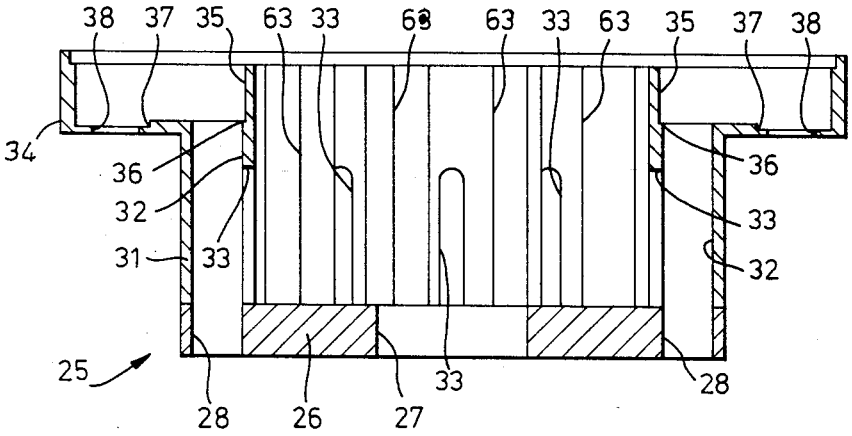
FIG. 3 is an axial section of the drum-shaped element of the machine of FIG. 2.

As shown in FIG. 3, drum 25 comprises a base wall 26 having a central hole 27 and a plurality of peripheral equally spaced holes 28, and a cylindrical side wall 31 provided with a plurality of axial equally spaced holes 32, each aligned with a corresponding hole 28.

The inside of drum 25 communicates with the lower end of hopper 16 through its upper open end, and with each hole 32 corresponding with a slit 33 provided through side wall 31.

Figure 5:
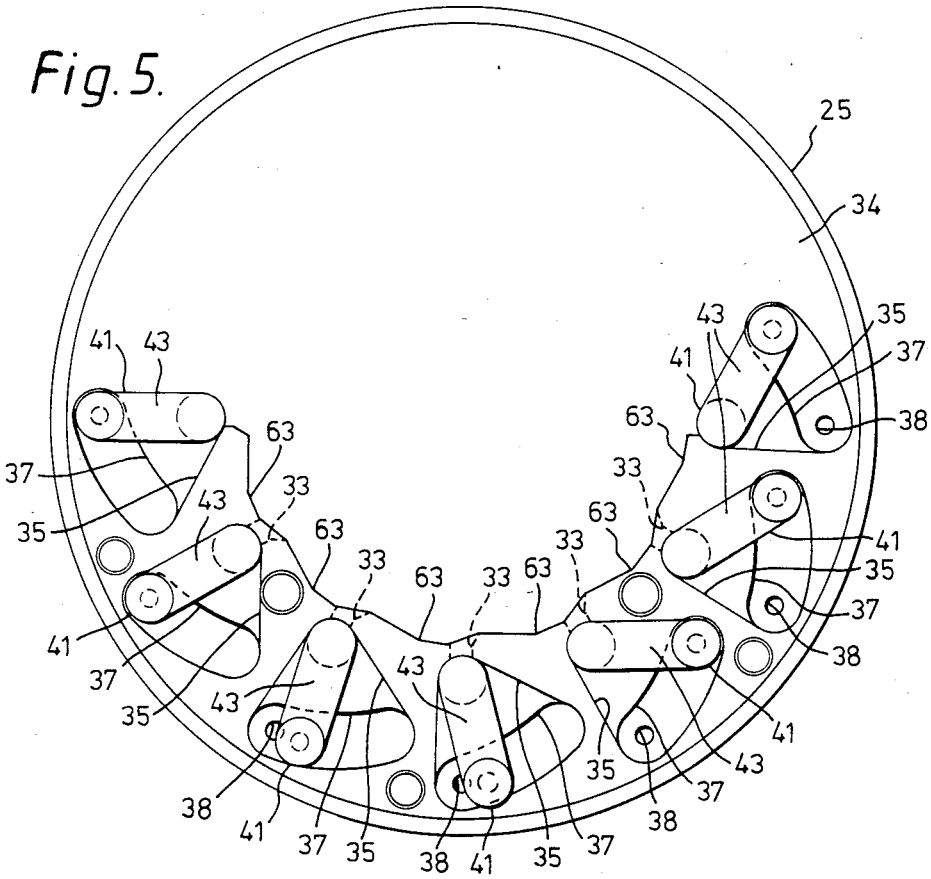
FIG. 5 is a plan view of the drum-shaped element of FIG. 3.

Drum 25 further comprises an upper annular member 34 extending radially outward from wall 31 and provided, on its upper surface, with a plurality of equally spaced recesses 35, each of which is arranged above the upper end of a corresponding hole 32. As shown in FIG. 5, each recess 35 is substantially triangular in shape, and has a first lateral side extending substantially parallel to the external periphery of annular member 34, and a second and a third lateral side extending substantially towards the axis of annular member 34. At its apex defined by its second and third lateral sides, each recess 35 is provided with an axial hole 36 coaxial with the corresponding hole 32 and communicating therewith.

Each recess 35 is also provided with a groove 37 extending along its first lateral side and communicating with the outside through an axial hole 38 arranged at one end of the aforementioned first lateral side.

Each recess 35 defines, together with its groove 37 and relevant holes 36 and 32, a substantially L-shaped dosing chamber accommodating a respective tubular dosing member 41. In particular, the aforementioned dosing chamber comprises a first and a second portion arranged at substantially right angles to one another, one of said two portions consisting in recess 35.

Figure 4:
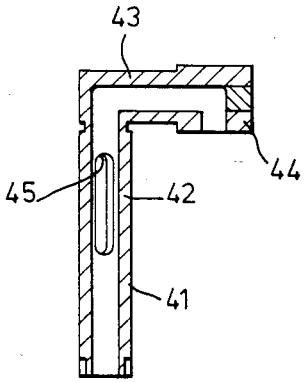
FIG. 4 is an axial section of the valve of the machine of FIG. 2.

As shown in FIG. 4, each dosing member 41 is also substantially L-shaped and comprises a first tubular portion 42 rotary mounted inside respective hole 32 and 36 and extending therealong, and a second tubular portion 43 extending substantially at right angles with portion 42. Portion 43 is mounted inside respective recess 35 and has a free end portion 44 movable therein along groove 37. Portion 42 rotates inside holes 32 and 36, between a release position, in which end portion 44 is arranged above respective hole 38, and an intake or paste receiving position, in which end portion 44 is arranged at the end of groove 37 opposite to respective hole 38.

Tubular portion 42 of each dosing member 41 is provided with a lateral slit 45 which communicates with the corresponding slit 33 when dosing member 41 is arranged in said intake position.

As shown in FIG. 3, an Archimedean screw 47 is mounted inside hopper 16 and drum 25 and is keyed on a shaft 48, one end of which rotatably engages hole 27 and a hole 51 which is provided centrally through a second drum 52 coaxial and integral with drum 25.

Machine 6 further comprises a lower fixed support table 53 supporting drum 52 and a plurality of vertical peripheral pillars 54 extending upward from table 53 and connected, at their upper ends, to a cover plate 55 extending horizontally above hopper 16. Cover plate 55 supports a torque limiting device 56 arranged between plate 55 and the upper end of a shaft 57, the lower end of which is connected to the upper end of shaft 48.

In order to improve the downward movement of paste 7 along hopper 16 and drum 25, the inner surfaces of portions 18 and 21 of hopper 16 and of wall 31 of drum 25 are provided with axial grooves 61, 62 and 63, respectively.

Drum 52 comprises a cylindrical upper portion 65 extending upwardly from table 53, and rigidly connected to, an annular member 66 provided with two toothed crowns 67 coaxial with shaft 48. Conveyor 14 comprises a chain 68 engaging both crowns 67 and a plurality of blocks 71 each provided with a seat 72 for a respective bottom 2 and a seat 73 for a respective cap 3.

Drum 52 is further provided with a plurality of axial holes 74 each coaxial with a hole 28 and a hole 32, and each accommodating a rotary tubular driving element 75. The upper end of driving element 75 is connected to the lower end of portion 42 of the dosing member 41 for rotation therewith. The lower end of driving element 75 is connected to driving means (not shown) adapted to oscillate element 75 about its axis during rotation of drum 52 about its axis.

Each element 75 is slidably enaged by a piston 76 having an upper piston head 77 slidably engaging a lower part of portion 42 of the respective dosing member 41.

In use, hopper 16 and drums 25 and 52 are brought into rotation by chain 68 of conveyor 14 relative to screw 47, thus causing a downward movement of paste 7 along hopper 18 and drum 25, towards base wall 26. The downward movement is facilitated by the presence of axial grooves 61, 62 and 63.

In normal conditions, screw 47 remains stationary; however, when the torque transmitted by paste 7 to screw 47 exceeds a predetermined value, torque limiting device 56 allows screw 47 to rotate so as to avoid undue tensions applied to chain 68.

Owing to the above rotation of hopper 16 relative to screw 47, paste 7 under pressure is fed to slits 33, each of which constitutes an outlet for hopper 16 and an inlet for the corresponding dosing chamber formed by holes 28, 32 and 36, and recess 35.

Passage of paste 7 into each of the aforementioned dosing chamber is controlled by the oscillating dosing member 41, which is first arranged in its intake position, in which its slit 45, constituting an inlet for dosing member 41, faces the respective slit 33, thus allowing the passage of paste 7 into the above dosing chamber and into dosing member 41. Paste 7 under pressure flows inside dosing member 41 up to end portion 44 thereof, where it stops owing to the fact that the open end of end portion 44, constituting an outlet for dosing member 41, is arranged, in the above intake position, facing the end of the groove 37 away from hole 38 constituting an outlet for the aforementioned dosing chamber.

Dosing member 41 is then rotated into its delivery position, in which its slit 45 is no longer aligned with the respective slit 33, thus preventing communication between hopper 16 and the dosing chamber, and in which the open end of end portion 44 faces hole 38.

In connection with the above it is to be pointed out that dosing member 41 starts rotating and closing the communication between slits 45 and 33 when paste 7 is still flowing in, and that, at the same time, piston 76 starts moving upward so as to cause a precompression of paste 7 within dosing member 41, before member 41 reaches it delivery position.

When dosing member 41 reaches its delivery position, the upward movement of piston 76 within member 41 causes a metered quantity of paste 7 contained therein to flow outside through the open end of end portion 44 and the facing outlet hole 38, and into a bottom 2 of a capsule, advanced by conveyor 14.

The outflow of paste 7 through hole 38 is stopped by dosing member 41 returning to its intake position and by piston 76 returning to its lowermost position to start a new cycle.

Figure 2:
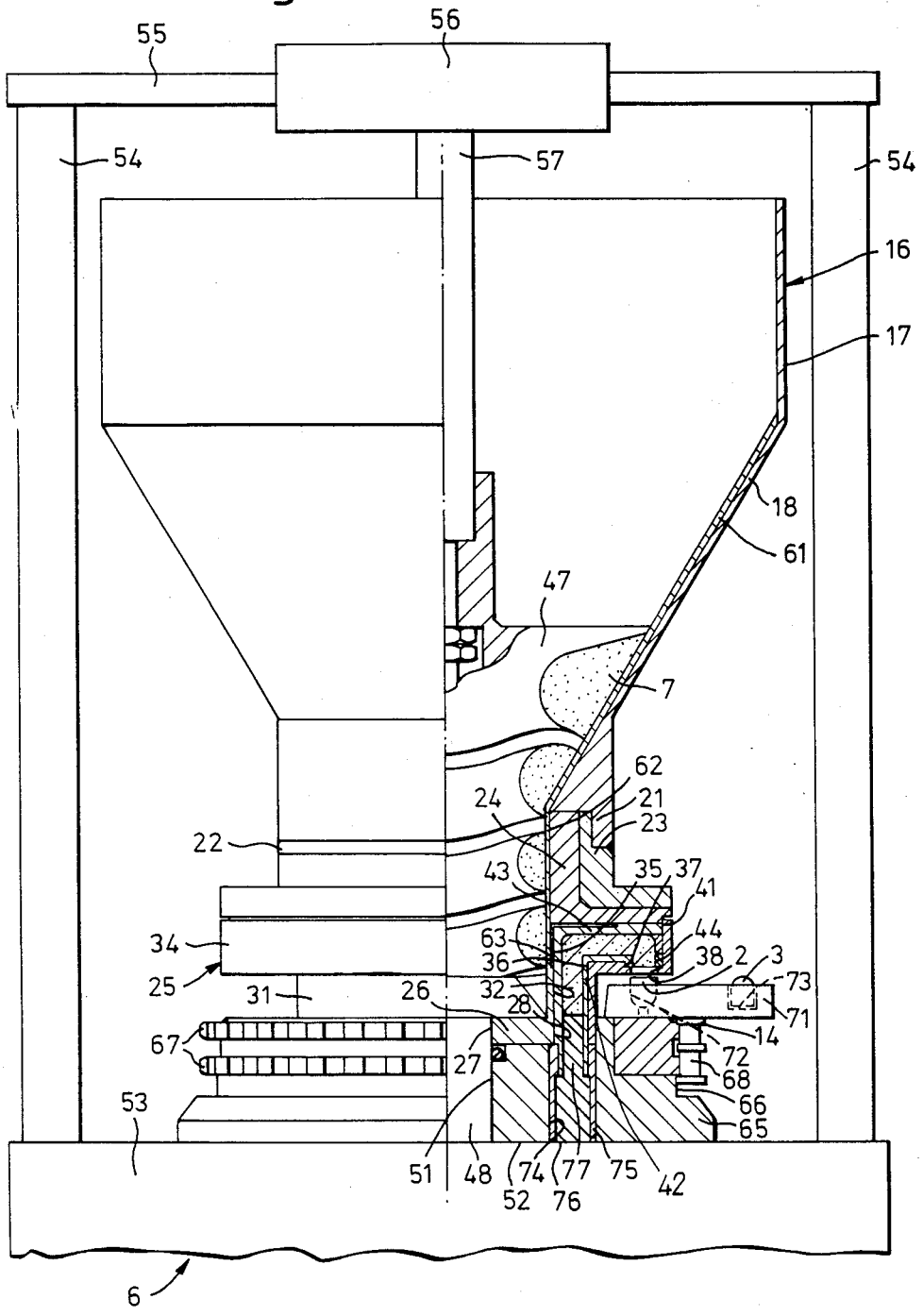
FIG. 2 is partly a side view of and partly an axial sectional view of a preferred embodiment of the filling machine of the present invention.

When paste 7 is fed into bottom 2, bottom 2 is lifted substantially into contact with the lower surface of annular member 34 by air fed from its seat 72 by a pneumatic circuit, and end portion of which is shown in phantom in FIG. 2.

The drive and transmission means for imparting all the above movements to dosing members 41 and respective pistons 76 normally consist of a plurality of vertical and annular cams which are not described herein since these means are a matter of normal practice for one skilled in the technical field to which machine 6 pertains.

I claim:

1. A machine for filling capsules with a pharmaceutical paste, comprising a hopper for said paste; a first outlet for said paste provided on said hopper; first pressure means cooperating with said hopper to push said paste in said hopper towards said first outlet; at least one dosing chamber for said paste; a first inlet and a second outlet for said paste provided on said dosing chamber, said first inlet communicating with said first outlet; a conveyor for a plurality of paste receiving bottom portions of capsules, said second outlet facing said conveyor; a dosing member arranged inside said dosing chamber and movable therein between a paste receiving position and a paste dispensing position; and a second inlet and a third outlet for said paste provided on said dosing member; said second inlet communicating with said first inlet when said dosing member is arranged in said paste receiving position, said third outlet communicating with said second outlet when said dosing member is arranged in said paste dispensing position, and second pressure means being provided which cooperates with said dosing member to push the paste therein towards said third outlet.

2. A machine as claimed in claim 1, wherein said first pressure means comprise an Archimedean screw arranged inside said hopper for rotation relative thereto about a longitudinal axis coinciding with a longitudinal axis of said hopper.

3. A machine as claimed in claim 2, further comprising fixed support means for said Archimedean screw, and torque limiting means interposed between said Archimedean screw and said fixed support means.

4. A machine as claimed in claim 1, wherein said dosing chamber and said dosing member are both substantially L-shaped and both comprise a first and a second portion arranged substantially at right angles to one another; said first portion of each of said dosing chamber and said dosing member is cyclindrical; said first portion of said dosing member being tubular and engaging the first portion of said dosing chamber in a rotary manner; said second portion of said dosing chamber being substantially triangular and communicating at one apex with said first portion of the dosing chamber, and being provided, at another apex, with said second outlet; and said second portion of said dosing member being tubular and provided with said third outlet and being mounted for oscillating within the second portion of said dosing chamber to and from a delivery position in which said third outlet faces said second outlet.

5. A machine as claimed in claim 4, wherein said second inlet consists of an aperture provided in said first portion of said dosing member.

6. A machine as claimed in claim 4, wherein said second pressure means consist of a piston slidably engaging said first portion of said dosing member.

* * * * *